US008348114B2

(12) United States Patent
Gleason, Jr.

(10) Patent No.: US 8,348,114 B2
(45) Date of Patent: Jan. 8, 2013

(54) BACKPACK FRAME AND BAG SYSTEM

(75) Inventor: Dana W. Gleason, Jr., Bozeman, MT (US)

(73) Assignee: Mystery Ranch, Ltd., Bozeman, MT (US)

( * ) Notice: Subject to any disclaimer, the term of this patent is extended or adjusted under 35 U.S.C. 154(b) by 418 days.

(21) Appl. No.: 12/690,104

(22) Filed: Jan. 19, 2010

(65) Prior Publication Data

US 2010/0176172 A1 Jul. 15, 2010

Related U.S. Application Data

(63) Continuation-in-part of application No. 12/533,983, filed on Jul. 31, 2009, and a continuation-in-part of application No. 10/907,087, filed on Mar. 18, 2005, now Pat. No. 7,673,777.

(51) Int. Cl.
*A45F 3/08* (2006.01)
*A45F 3/10* (2006.01)

(52) U.S. Cl. ..... 224/633; 224/645

(58) Field of Classification Search ..... 224/627–659, 224/917

See application file for complete search history.

(56) References Cited

U.S. PATENT DOCUMENTS

| | | | | |
|---|---|---|---|---|
| 4,040,548 | A | 8/1977 | Guglielmo | |
| 4,356,942 | A | 11/1982 | Hayes | |
| 4,361,259 | A | 11/1982 | Chanter | |
| 4,982,884 | A | 1/1991 | Wise | |
| 5,341,974 | A | 8/1994 | Robinson et al. | |
| 5,361,955 | A | 11/1994 | Gregory | |
| 5,564,612 | A | 10/1996 | Gregory | |
| 5,579,966 | A | 12/1996 | Krumweide et al. | |
| 5,704,530 | A | 1/1998 | Scherer | |
| 5,730,347 | A | 3/1998 | Finot | |
| 5,890,640 | A | 4/1999 | Thompson | |
| 6,135,334 | A | 10/2000 | Seichter | |
| 6,216,926 | B1 | 4/2001 | Pratt | |
| 6,276,584 | B1 | 8/2001 | McLachlan | |
| 6,607,107 | B2 * | 8/2003 | Dexheimer | 224/604 |
| 6,626,342 | B1 | 9/2003 | Gleason | |
| 6,889,882 | B1 | 5/2005 | Leep | |
| 7,971,764 | B2 * | 7/2011 | Sabbah | 224/650 |
| 2001/0025867 | A1 * | 10/2001 | Chuang | 224/627 |
| 2004/0178238 | A1 | 9/2004 | Le Gal et al. | |

FOREIGN PATENT DOCUMENTS

| | | |
|---|---|---|
| JP | 2001505801 | 5/2001 |
| JP | 2004523278 | 8/2004 |
| JP | 2006520242 | 9/2006 |
| JP | 2007008319 | 1/2007 |
| JP | 2008114063 | 5/2008 |

* cited by examiner

*Primary Examiner* — Justin Larson
(74) *Attorney, Agent, or Firm* — Husch Blackwell LLP

(57) ABSTRACT

A backpack system is provided including an external frame, a pack bag and a sling configured for extending between the frame and pack bag providing a space between the frame and pack bag for accommodating heavy or bulky cargo therebetween. The sling can be extended or retracted in order to selectively adjust the distance between the pack bag and frame. The backpack system may also include a pouch for supporting a lower end of relatively long object therein, which may be carried in the space between the pack bag and frame. In one embodiment, the pack bag is equipped with stiffening members for supporting the pack bag when not mounted directly to the frame.

9 Claims, 7 Drawing Sheets

BACKPACK FRAME AND BAG SYSTEM

CROSS-REFERENCE TO RELATED APPLICATIONS

This application is a continuation-in-part of and claims priority to U.S. application Ser. No. 10/907,087 filed Mar. 18, 2005, now U.S. Pat. No. 7,673,777 issued Mar. 9, 2010, to Dana Wright Gleason Jr. entitled Backpack Frame System and U.S. application Ser. No. 12/533,983 filed Jul. 31, 2009 to Dana Wright Gleason Jr. entitled backpack Frame System, which is currently pending and is a continuation-in-part of U.S. application Ser. No. 10/907,087. The entire disclosure, including the specification and drawings, of both above-referenced applications are incorporated herein by reference.

BACKGROUND OF THE INVENTION

Backpacks have been used for many years to carry a given load of contents on the back of a user. Modern backpacks designed and configured to carry moderate to large loads usually fall into one of two categories: external frame backpacks and internal frame backpacks. External frame backpacks normally include a rigid frame with shoulder straps and a pack bag connected directly to that frame.

Often, backpack users have the need to carry heavy, oversized or awkwardly shaped objects. Typically, users will fasten or strap those objects to the easiest attained location, which is generally on the outside of the pack bag. When these oversized objects are attached to the outside of the pack bag, the result is a load that is not well balanced and does not carry well. For instance, if a heavy object is attached to the back side of the pack bag, it will adversely affect the user's balance and stability, as the load is usually placed relatively far away from the user's back and center of gravity. This is especially true with regard to items typically carried by military personnel and members of tactical or special force teams. Those items can include mortar tubes, mortar base plates (which can weigh 30 pounds or more), radio packs, firearms, other weaponry and the like. Furthermore, when long objects, such as mortar tubes and firearms, are strapped to the bag, they often sway thereby further hindering the user's balance. Additionally, long objects, especially when positioned horizontally across the user's back or when allowed to sway, increase the user's overall width, which can have adverse impacts in crowded environments and tight surroundings. Furthermore, in addition to carrying oversized objects, users often desire to also carry a pack bag for transporting smaller contents.

Accordingly, a need exists for a backpack system that allows the user to carry heavy, oversized and awkwardly shaped objects relatively close to the user's back and center of gravity in a stable manner. A need also exists for a backpack system that allows a user to transport heavy, oversized and awkwardly shaped objects in addition to a pack bag. A further need exists for a backpack system that enables a user to carry long objects in a manner that does not increase the user's overall width.

SUMMARY OF THE INVENTION

One embodiment of the present invention is directed to a backpack system that includes an external frame with shoulder straps, a pack bag and a sling extending between a back side of the frame and a front side of the pack bag. The sling acts as a shelf and permits for space between the frame and pack bag for accommodating cargo therebetween when the sling is in an extended position. The sling can be extended or retracted in order to selectively adjust the distance between the pack bag and frame. In one embodiment, the sling is permanently affixed to a front lower edge of the pack bag and releasably coupled to the frame with straps having adjustable buckles mounted thereon. The sling may define a cutout region sized and shaped for receiving a relatively long object, such as a mortar tube or firearm, therethrough. Further, the backpack system can be equipment with a pouch or sock attached thereto for supporting the lower end of a long object.

Portions of the frame and pack bag may be comprised of or include patches of a material designed to reduce or eliminate inadvertent sliding or shifting any cargo carried between the frame and pack bag. The pack bag, in order to maintain its general shape when not directly mounted to the frame, can include stiffening members. In one embodiment, the pack bag has stiffening members located about its front panel. In one configuration, the pack bag is attached directly to and relatively snugly against the frame and may include a collar for hanging the pack bag on a top portion of the frame.

Certain embodiments of the invention are outlined above in order that the detailed description thereof may be better understood, and in order that the present contributions to the art may be better appreciated. In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

DESCRIPTION OF THE SEVERAL VIEWS OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
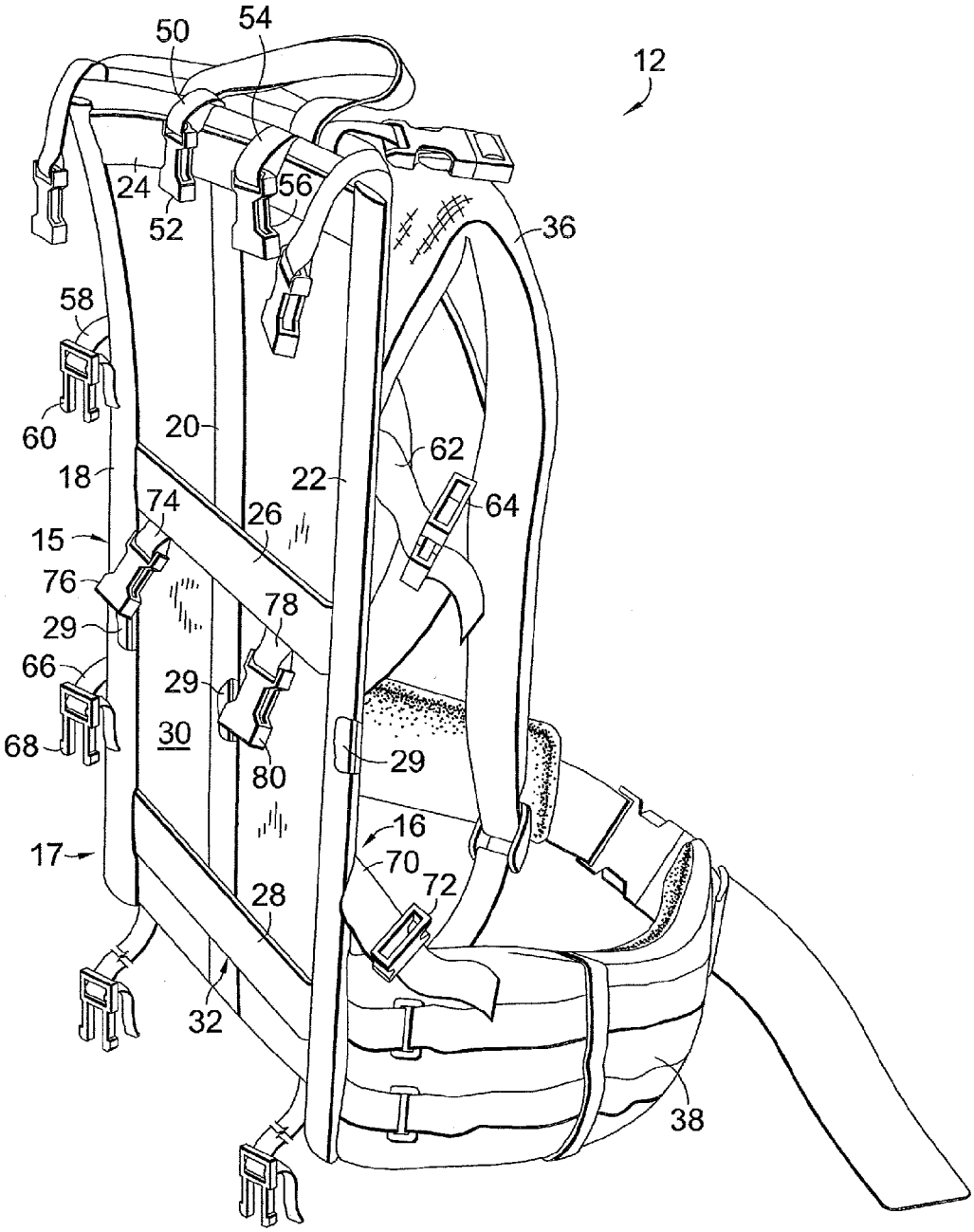
FIG. 1 is a rear perspective view of an external frame assembly of the backpack system in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. The description of the invention will use terms such as vertical, horizontal, top and bottom. These terms are used to describe the components of the backpack system 10 when it is in its normal upright orientation.

One embodiment of the present invention is directed generally to a backpack system 10 comprised of a frame system 12 and pack bag 14. As will be described in further detail below, the pack bag 14 may be mounted to the frame system 12 in a manner providing space 176 between the pack bag 14 and frame system 12 for accommodating cargo, including heavy, oversized or awkwardly shaped objects, therebetween. When configured in this manner, the backpack system 10 may optionally include a sling 156 extending between the frame system 12 and the pack bag 14. Additionally, the pack bag 14 may include stiffeners 112, 114 and 116 for providing the pack bag 14 with structural rigidity when the pack bag 14 is positioned at a distance from the frame system 12. Furthermore, the backpack system 10 can include a pouch or sock 180 and 182 for supporting long objects. The pack bag 14 may also be mounted directly to the frame system 12.

Turning to FIG. 1, the frame system 12 can be comprised of a base frame 15, shoulder straps 36 and a hip belt 38. The base frame 15 has front and back sides 16 and 17. The shoulder straps 36 and hip belt 38 extend from the front side 16 of the base frame 15. In one embodiment, the base frame 15 includes a left upright member 18, a center upright member 20 and a right upright member 22. As shown, base frame 15 further includes an upper cross member 24, an intermediate cross member 26 and a lower cross member 28 extending between the left and right upright members 18 and 22. The cross members 24, 26 and 28 may be directly attached on opposing lateral ends thereof with the left and right upright members 18 and 22. As illustrated, a membrane 30, which may be formed of a flexible material, extends laterally across the vertical members 18, 20 and 22 and vertically across the cross members 24, 26 and 28 and below the lowermost cross member 28. By affixing only the lateral ends of the cross members 24, 26 and 28 with the outermost upright members 18 and 22, gaps 32 are formed between the cross members 24, 26 and 28 and the membrane 30. The gaps 32 may also extend between the cross members 24, 26 and 28 and the center upright member 20. The members 18, 20, 22, 24, 26 and 28 may be solid elements or may be constructed of a rigid or semi-rigid stay 29 housed within a sleeve 31. In general, while the frame system 12 may be constructed the same as or substantially similar to the frame system disclosed and shown in U.S. application Ser. Nos. 10/907,087 and 12/533,983, it may also take the form of any other suitable backpack frame now known or hereafter developed. By way of example, the base frame 15 may be constructed of tubular members or rods (e.g., formed of aluminum or other metals or rigid materials) or may be formed from a molded plastic or formed composite structure.

Figure 2:
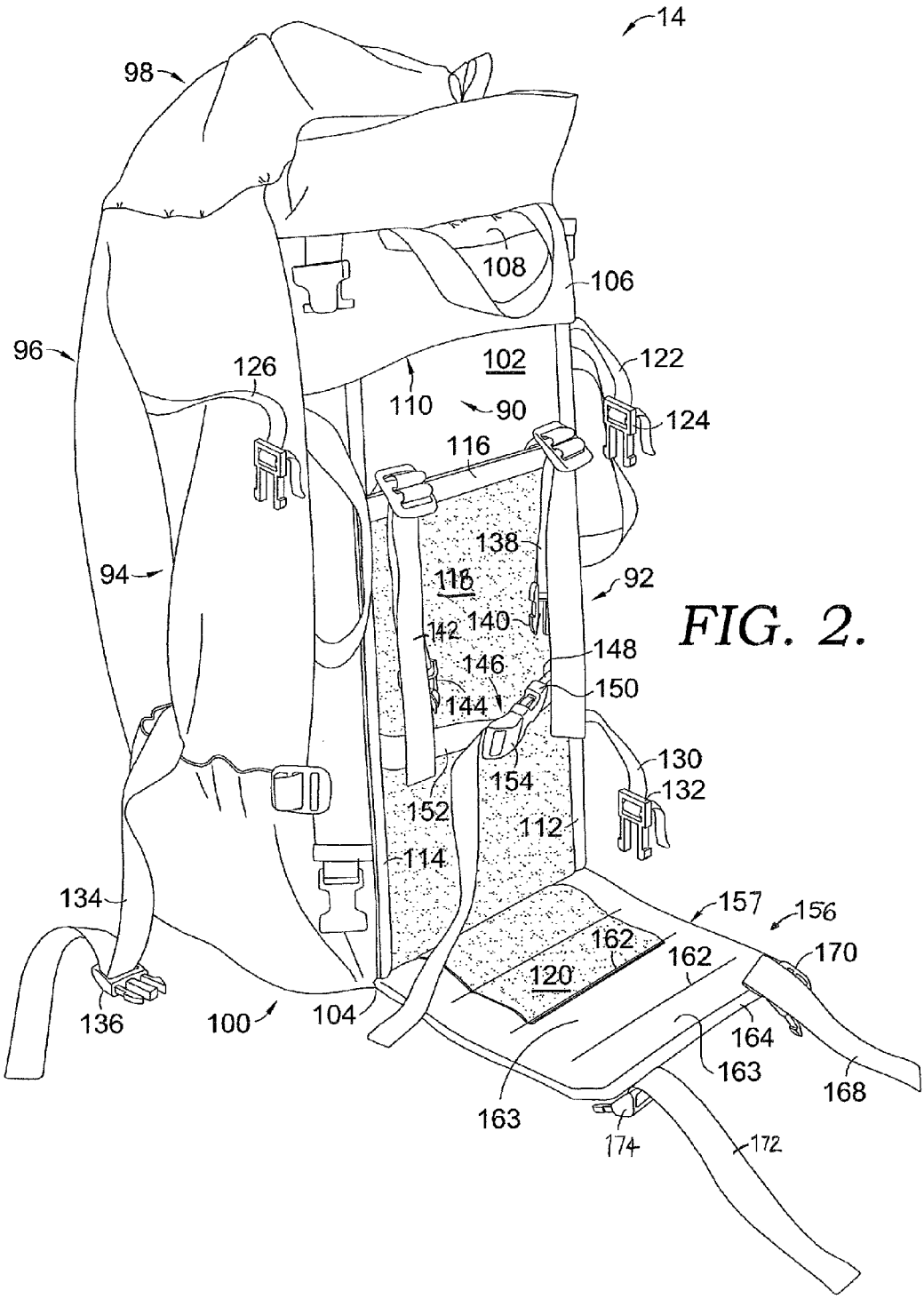
FIG. 2 is a front perspective view of a pack bag and sling of the backpack system in accordance with one embodiment of the present invention.

FIG. 2 illustrates a cargo carrying device or pack bag 14 that may be used in connection with one embodiment of the invention. The pack bag 14 can come in a variety of shapes and sizes and can be made from a flexible sheet material (e.g., nylon, polyester or canvas), molded plastic, leather, metal or any other materials known in the art. The pack bag 14 can be similar to pack bags of conventional backpacks and normally includes a main compartment 89 with an opening (not shown) that may be secured by a zipper, hook and loop fastener or other fastening means. The main compartment 89 is defined by front and back sides 90 and 96, left and right sides 92 and 94 and top and bottom ends 98 and 100. The pack bag 14 may further include a number of sub compartments, pockets, flaps, and partitions as known in the art. The pack bag 14 may be used to carry food, clothing, gear, equipment, supplies and all other items suitably shaped and sized to fit within the pack bag 14. While the pack bag 14 is described herein as a conventional-type bag, it is understood that existing containers such as other packs, boxes, canisters or virtually any suitably sized container or bag can be modified to become a pack bag 14. Additionally, it will be understood that pack bag 14 may be replaced with any number of other objects that are suitable for coupling with the frame system 12.

Figure 3:
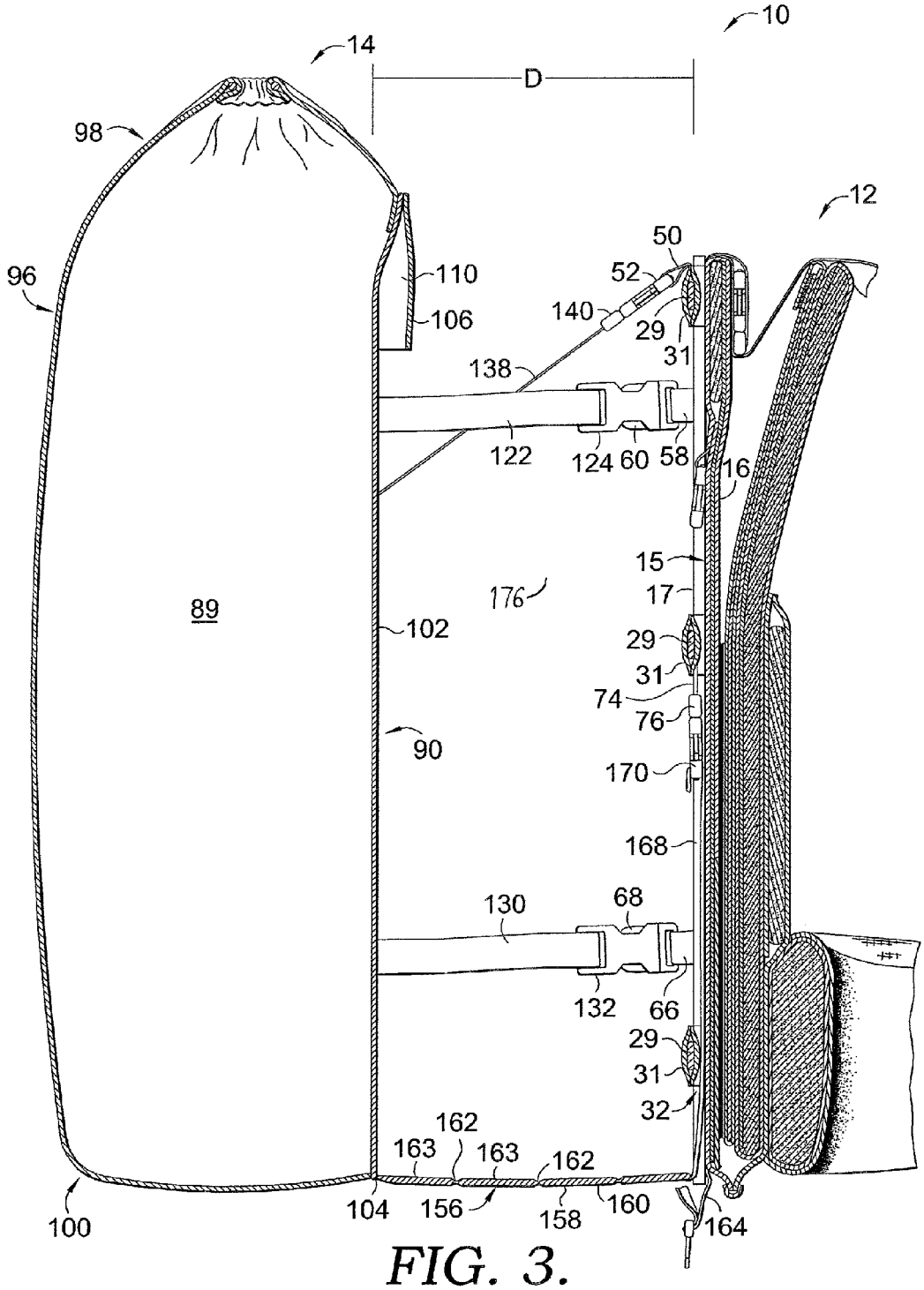
FIG. 3 is a sectional view illustrating the pack bag mounted to the external frame assembly with a space therebetween for carrying cargo in accordance with one embodiment of the present invention.

As demonstrated in FIG. 3, the pack bag 14 may be mounted to the frame system 12 in a manner providing space 176 between the pack bag 14 and frame system 12 for accommodating cargo therebetween. Examples of cargo and equipment that can be carried in the space 176 between the pack bag 14 and frame system 12 include tactical radios, ammunition cans, jerry cans, fuel or water canisters, mortar tubes, mortar tube base plates, firearms, tactical or hunting equipment, tents, bags, sleeping bags, humans, animals, dressed or quartered game and any other suitably sized objects, including relatively heavy, oversized or awkwardly-sized objects. The space 176 created between the pack bag 14 and frame system 12 allows the user to position such objects relatively close to the user's back and center of gravity. This facilitates better weight distribution of the load and improves the user's balance in comparison to cases where objects are strapped to the outside of the pack bag 14 farther from the user's center of gravity. Additionally, it enables longer objects, such as firearms and mortar tubes, to be secured in a stable manner and in a fashion that keeps the user's width as minimal as possible.

In addition to the frame system 12 and pack bag 14, the backpack system 10 may also include a sling 156. The sling 156 acts as a shelf for supporting cargo positioned between the frame system 12 and pack bag 14. When the sling 156 is tightened (i.e., shortened), it reduces the distance D between the frame system 12 and pack bag 14, and when completely tightened, holds the pack bag 14 generally snug against the frame system 12. When the sling is loosened (i.e., lengthened), it allows the distance D between the frame system 12 and pack bag 14 to be increased. In one embodiment, distance D is generally variable between about zero inches and about 12 inches or more. This allows a wide variety of objects to be carried within the space 176 between the frame system 12 and pack bag 14, including those objects listed above.

The sling 156 may be permanently affixed to the pack bag 14 and/or frame system 12 or may be releasably attached to the pack bag 14 and/or frame system 12. As illustrated in the figures, the sling 156 is permanently attached to a front lower edge 104 of the pack bag 14. While the figures show the sling 156 attached to the front lower edge 104, it will be understood that sling 156 may be attached to the pack bag 14 at locations other than edge 104, including locations above or below edge 104.

In one embodiment, a shelf portion 157 of the sling 156 extends from the edge 104 and terminates at a distal end 164. Extending from the distal end 164 of the shelf portion 157 are straps 168 and 173 having adjustable buckles 170 and 174 respectively fitted thereon for adjusting the effective length of the straps 168 and 172 and releasably coupling the sling 156 to the base frame 15. As illustrated in the figures, sling 156 is similar in nature to the elongated spade disclosed in the above-referenced patent applications. However, it will be understood that the sling 156 need not be constructed in such a manner and may, in other embodiments, consist of other structure, including straps, webbing, formed plastic or composite materials or any other suitable structure extending between the frame system 12 and pack bag 14.

As best illustrated in FIG. 3, the sling 156 may comprise a rigid or semi-rigid inner support material 160, such as high-density foam, plastic, composite or other material suitable for increasing the sling's rigidity and restricting side-to-side sway of the pack bag 14 relative to the frame system 12. The support material 160 may be enclosed by a shell liner 158, which may be constructed of materials similar to those used in constructing the pack bag 14. In one embodiment, the sling 156 includes one or more lateral flex lines 162 enabling the sling 156 to flex horizontally. Flex lines 162 can be formed by sewing the liner 158 through the support material 160 or by interrupting the support material 160 along the flex lines 162. The flex lines 162 allow the sling 156 to be incrementally inserted in the gap 32 in front of one or more of the cross members 24, 26 and 28, enabling a user to adjust the distance D between the frame system 12 and pack bag 14. Put differently, the flex lines 162 divide the sling 156 into partitions 163 such that a selectable number of the sling partitions 163 may be slid in front of one or more of the cross members 24, 26 and 28 and the remaining sling partitions 163, if any, are utilized to form a platform or shelf 157 for supporting contents on the sling 156.

The buckles 170 and 174 attached to the straps 168 and 172 that extend from the shelf portion's distal end 164 can be coupled with the buckles 76 and 80 attached to cross member 26 in order to releasably connect the sling 156 to the base frame 15. Buckles 170 and 174 can be slid toward or away from the distal end 164 of sling 156 along straps 168 and 172 in order to adjust the effective length of the sling 156 and thereby increase or decrease the distance D between the frame system's back side 17 and the pack bag's front side 90. While the figures show buckles 76 and 80 affixed to cross member 26 via straps 74 and 78, it will be understood that buckles 76 and 80 may be attached to the base frame 15 at any desired location, including other cross members.

The cargo placed between the frame system 12 and pack bag 14 may be strapped to the base frame 15, strapped to the pack bag 12 or merely rest between the base frame 15 and pack bag 14. The pack bag 14 may include a restraint device 146 having straps 148 and 152 with adjustable buckles 150 and 154 that may be coupled together to secure cargo against the front side 90 of the pack bag 14. One or more of the sling 156, the front side 90 of the pack bag 14, the membrane 30 and the sleeves 31 may be comprised entirely of or may include patches 118 and 120 of a material having gripping characteristics. By way of example, this material can be a Hypalon® coated fabric, a rubber material, hook or loop material or any other material known for providing grip or tractive properties. This material is in place to reduce or eliminate any inadvertent sliding and shifting of the cargo contained within space 176. In one embodiment, one or both of the patches of material 118 and 120 are backed with foam or other padding so as to firmly press against the cargo being carried within the space 176.

Figure 6:
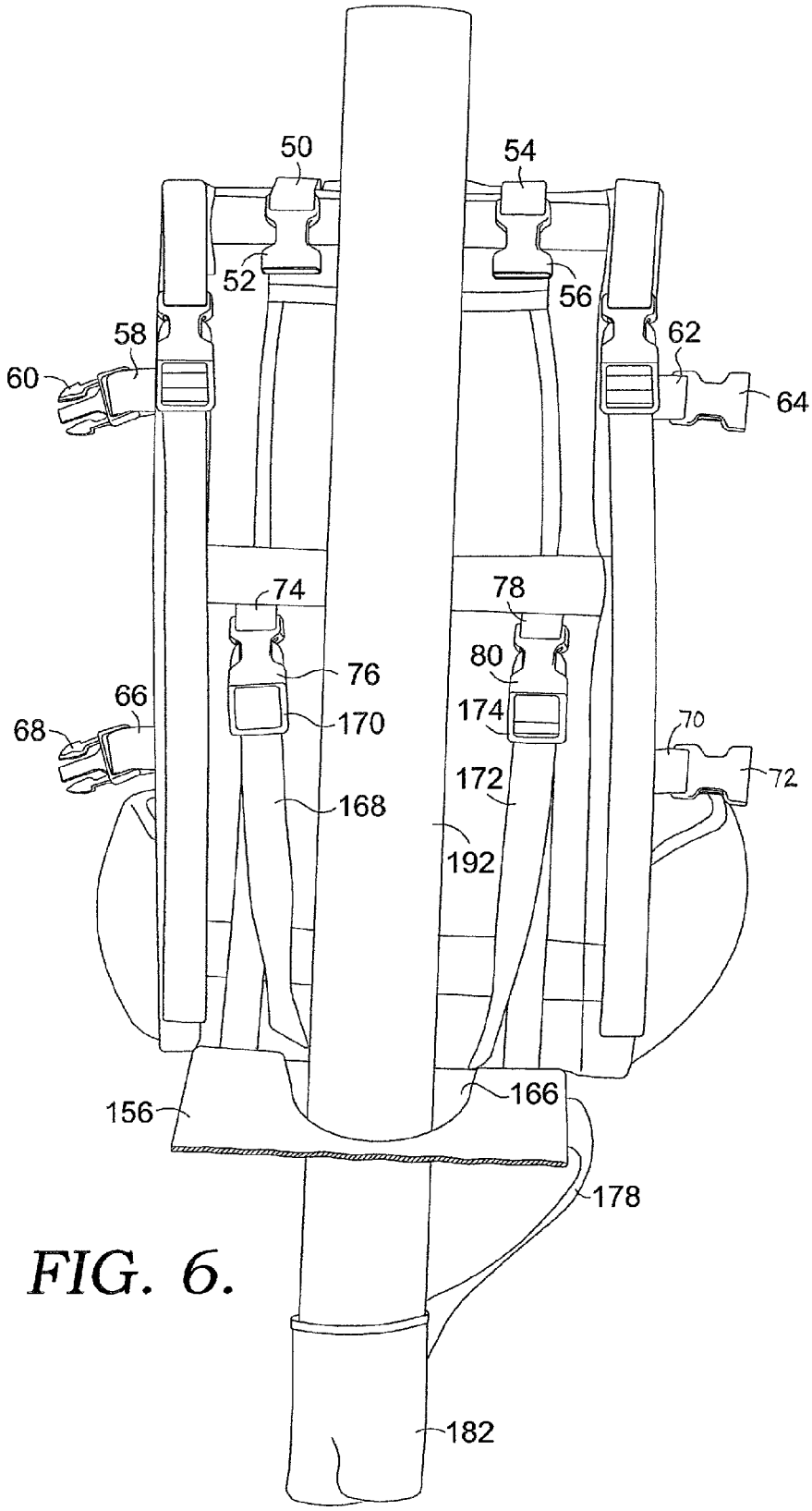
FIG. 6 is a is a sectional view illustrating a mortar tube supported by a pouch and positioned between the external frame assembly and pack bag in accordance with one embodiment of the present invention.
Figure 7:
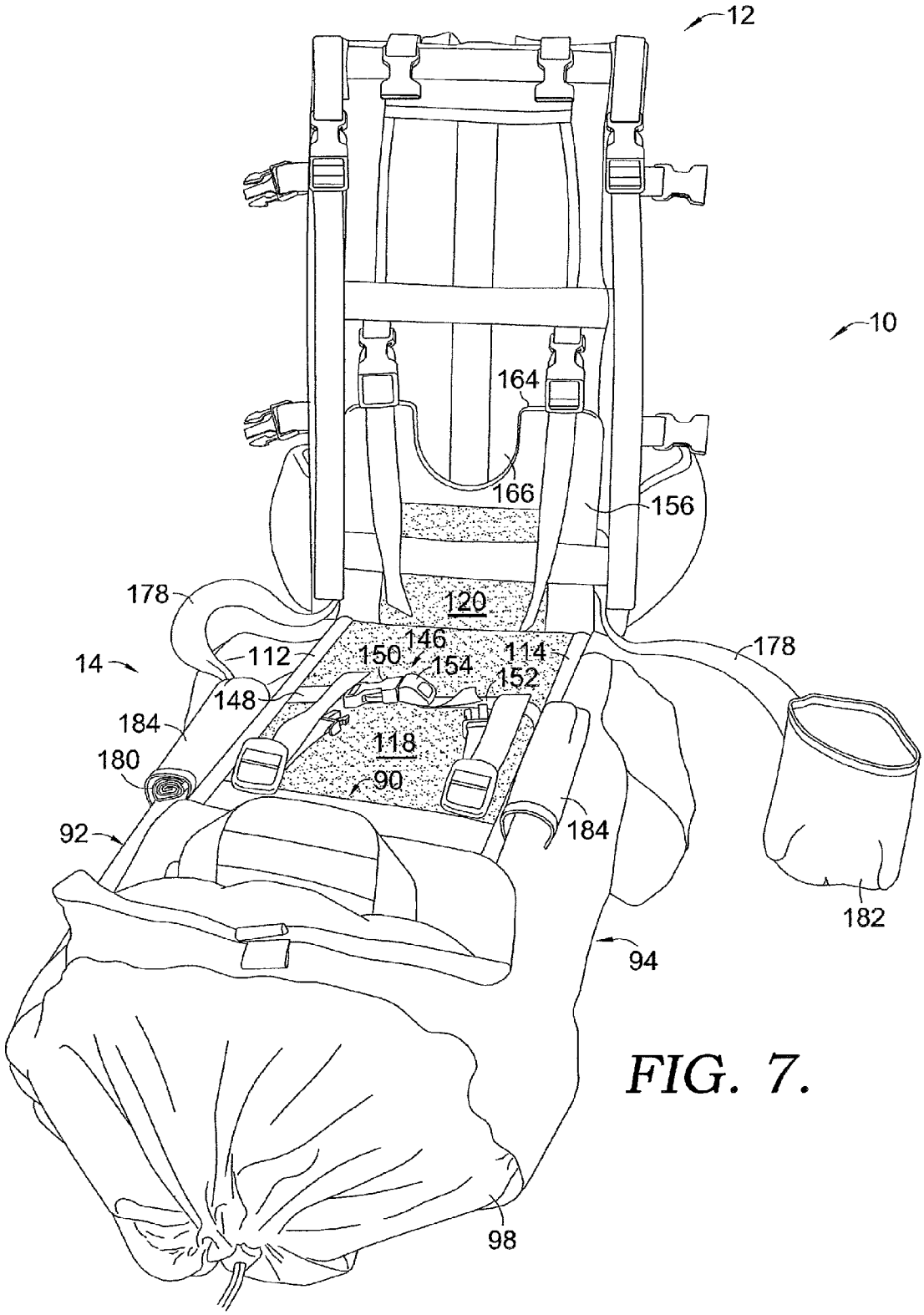
FIG. 7 is a perspective view illustrating the pack bag coupled to the external frame assembly via a sling and showing the pack bag opened away from the external frame assembly in accordance with one embodiment of the present invention.

As best shown in FIGS. 6 and 7, the sling 156 may optionally include a cutout 166 shaped and sized for receiving a long object, such as a mortar tube or firearm therethrough. The cutout portion 166 may be of any shape and placed in any suitable location. In other embodiments, the sling 156 may include multiple cutouts 166 or a cutout 166 that extends the entire length of the sling 156.

In addition to the sling 156, the pack bag 14 is coupled to the frame system 12 with straps or other attachment means. For instance, as shown in the figures, the pack bag 14 and base frame 15 are equipped with a set of straps 50, 54, 138 and 142 for carrying a portion of the cargo's load within the pack bag 14 and space 176. Straps 50 and 138 are coupled together by buckles 52 and 140 and straps 54 and 142 are coupled together by buckles 48 and 144. In addition to carrying a portion of the vertical load of the cargo, straps 50, 54, 138 and 142 also position the top end 98 of the pack bag 14 relative to the base frame 15. The system 10 may also include various compression straps and buckles for attaching the pack bag 14 to the frame system 12 and for stabilizing and compressing the cargo contained with the pack bag 14 and space 176. In one embodiment, upper compression straps 58 and 122 are coupled by buckles 60 and 124, upper compression straps 62 and 126 are coupled by buckles 64 and 128, lower compression straps 66 and 130 are coupled by buckles 68 and 132 and lower compression straps 70 and 134 are coupled by buckles 72 and 136. The buckles 124, 128, 132 and 136 may be adjusted to various positions along straps 122, 126, 130 and 134 in order to increase or decrease the distance D between the frame system 12 and pack bag 14 and in order to provide a desired amount of compression on the cargo within the space 176 and pack bag 14.

All of the straps described herein are normally constructed of a durable and fabric-like material, such as nylon or polyester strapping similar to the material frequently used in automobile seatbelts or any other type of material suitable for use in connection with the present invention. The straps may be affixed to the pack bag 14 and base frame 15 by sewing or welding the straps to their respective components or may be removably attached, for example, with hook and loop fasteners. All of the buckles described herein may be quick release buckles comprised of corresponding releasable male and female buckle connectors or any other type of buckle suitable for use in connection with the present invention.

When the pack bag 14 is positioned at a distance from the frame system 12, it is often desirable for the pack bag 14 to have some structural rigidity so that it does not sag when apart from the base frame 15 and maintains its general shape when synched against the cargo contained within the space 176. However, bags used in connection with external frame backpack systems typically do not include any structural framing. As shown in FIG. 2, two upright stiffeners 112 and 114 and one cross stiffener 116 are attached to the front side of the pack bag 14. The stiffeners 112, 114 and 116, which may be provided in any number and configuration, can be made of plastic, metal, carbon fibers, reinforced fiberglass, wood or any other suitable rigid, semi-rigid or elastically deformable material.

Figure 5:
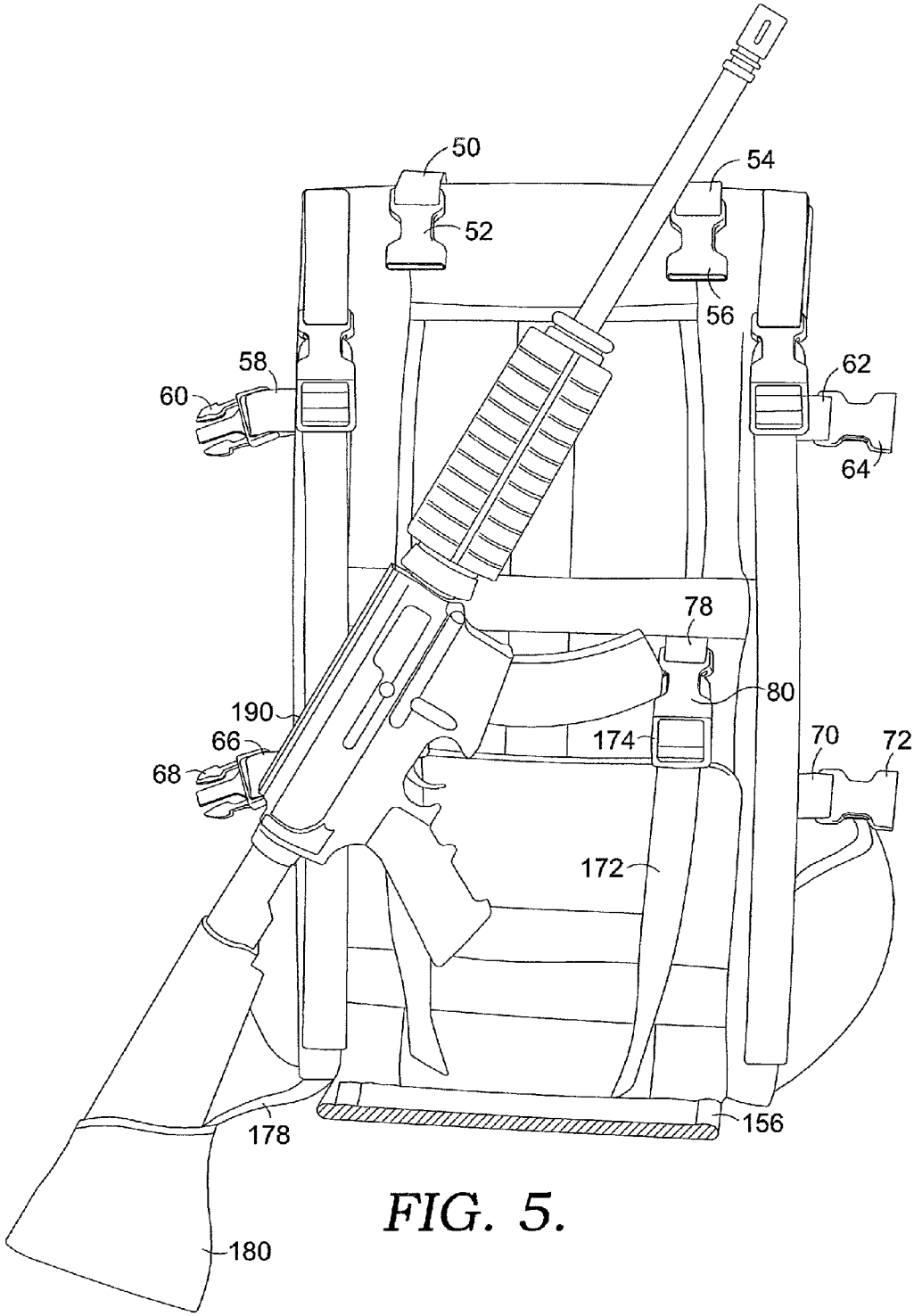
FIG. 5 is a sectional view illustrating a firearm supported by a pouch and angled across the backpack system between the external frame assembly and pack bag in accordance with one embodiment of the present invention.

Turning now to FIGS. 5 and 6, longer objects such as firearms 190 and mortar tubes 192 may be contained in the space 176 between the frame system 12 and pack bag 14. These objects may be position such that their lower ends extend below the sling 156. In one embodiment, one or more pouches or socks 180 and 182 are provided. The socks 180 and 182 can be attached directly to the sling 156, frame system 12 or pack bag 14 or may be coupled thereto with straps 178 that may be adjustable in length. The socks 180 and 182 can be interchangeable and specifically tailored for particular objects or loads that are being carried. For example, one sock 180 can be slender and configured to support the butt end of a firearm and another sock 182 may be round and configured to support the lower end of a mortar tube. The socks 180 and 182 may also be attached to sling 156, frame system 12 or pack bag 14 in a number of locations. As seen in FIG. 5, sock 180 is attached to the base frame 15 and the firearm 190 is angled across the user's back. As seen in FIG. 6, sock 182 is attached to the sling 156 and the mortar tube is received through the cutout region 166 and is carried in a generally vertical orientation. In one embodiment, the sock 180 and 182 can be used in connection with a backpack system that does not include a sling 156. When not in use, the socks 180 and 182 and straps 178 can be placed within a sleeves or pockets 184 located on the pack bag 14, as demonstrated in FIG. 7.

Figure 4:
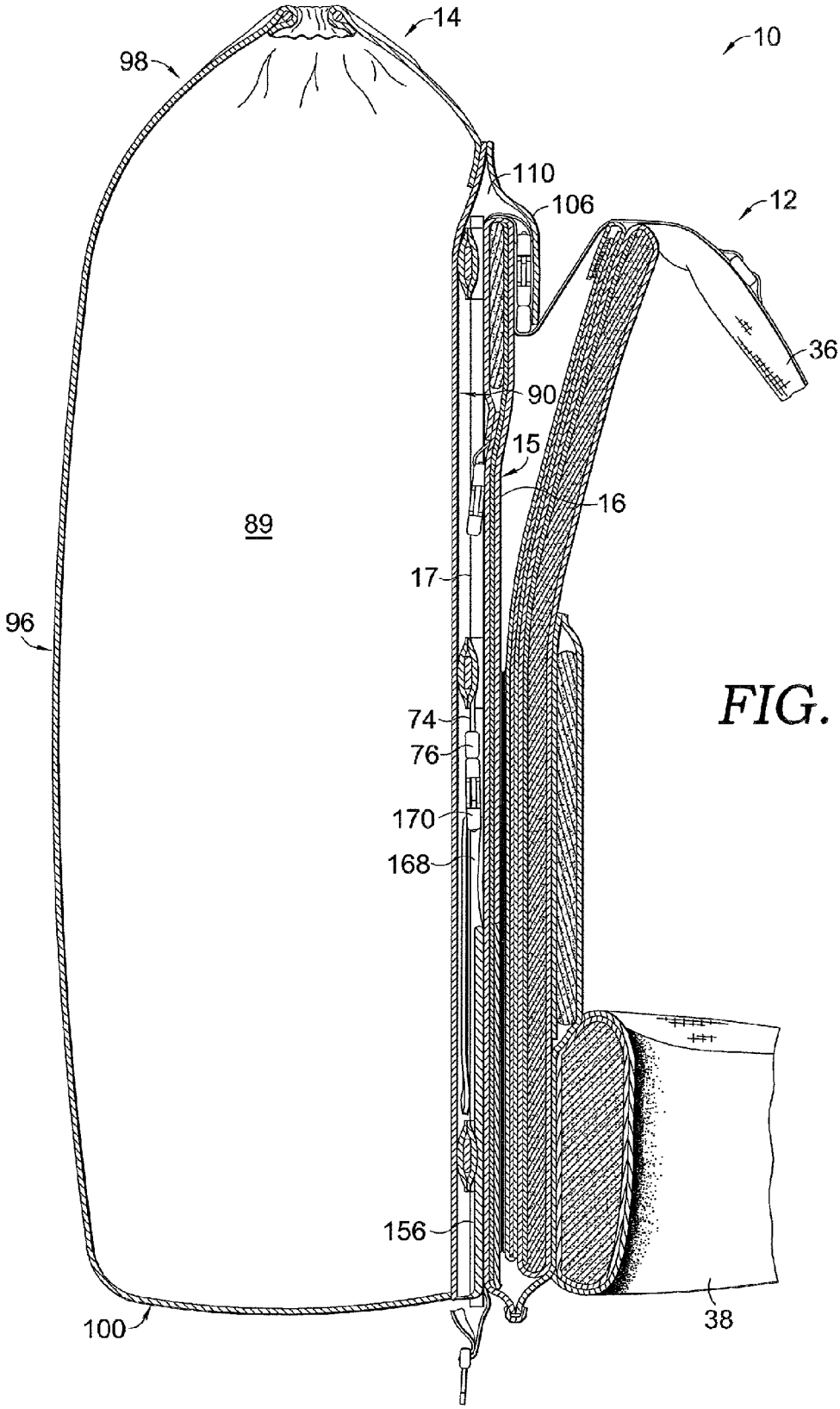
FIG. 4 is a sectional view illustrating the pack bag mounted directly to the external frame assembly in accordance with one embodiment of the present invention.

As illustrated in FIG. 4, the pack bag 14 may be mounted directly to the frame system 12. In such a case, the pack bag 14 may include an inverted pocket 110 defined between a collar 106 and a front surface of the pack bag 102. As shown, the pocket 110 is sized and configured for receiving an upper portion of the base frame 15, upon which the pack bag 14 may be hung. When in this configuration, buckles 170 and 174 can be slid toward the distal end 164 of sling 156 along straps 168 and 172 in order shorten the effective length of the sling 156 and, therefore, pull the pack bag 14 toward the base frame 15. As shown in FIG. 2, the collar 106 can have an opening 108 defined therein. Long items, such as the barrel of a firearm 190 can be directed through the opening 108 in order to further secure and stabilize the object in place. Additionally, compression straps 122, 126, 130 and 134 can be shortened in order to pull the pack bag 14 against the base frame 15.

From the foregoing, it may be seen that the backpack frame and bag system of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

I claim:

1. A backpack comprising:

an external frame having a front side and a back side;

at least one shoulder strap extending from the front side of said frame;

a cargo carrying device having a front side, said cargo carrying device being a bag configured to be removably mounted to said frame, said bag further including a pair of generally upright stiffening members attached to the front side thereof and at least one generally horizontal stiffening member extending between the pair of upright stiffening members;

an elongated sling extending generally between the back side of said frame and the front side of said cargo carrying device, said sling configured for permitting space between said frame and said cargo carrying device for accommodating cargo therebetween when said sling is in an extended position; and a first attachment device extending between and connecting said frame and said cargo carrying device, said first attachment device located above said sling.

2. A backpack comprising:

an external frame having a front side, a back side, at least two generally upright frame members in spaced apart relationship with a membrane extending therebetween and at least one cross frame member extending between said upright frame members and overlying a rearwardly facing surface of said membrane forming a gap therebetween configured for receiving said sling;

at least one shoulder strap extending from the front side of said frame;

a cargo carrying device having a front side;

an elongated sling extending generally between the back side of said frame and the front side of said cargo carrying device, said sling configured for permitting space between said frame and said cargo carrying device for accommodating cargo therebetween when said sling is in an extended position; and a first attachment device extending between and connecting said frame and said cargo carrying device, said first attachment device located above said sling.

3. The backpack of claim 2 wherein said sling is received in said gap and releasably connected to said frame.

4. The backpack of claim 3 wherein said sling includes a plurality of flex lines enabling said sling to flex horizontally and be inserted incrementally into said gap.

5. A backpack comprising:

an external frame system having front and back sides and a gap defined between at least one generally horizontal frame member and at least one generally upright frame member;

at least one shoulder strap extending from the front side of said frame system;

a bag having a front side with at least one generally upright stiffening member attached thereto;

an elongated sling extending from a lower portion of the front side of said bag, said sling configured for being received within said gap and permitting a space between said frame system and said bag for accommodating cargo therebetween;

a first attachment device extending from a distal end of said sling and connected to said frame system, wherein said first attachment device may be extended to increase the amount of space between said frame system and said bag and may be retracted to decrease the amount of space between said frame system and said bag; and a second attachment device extending between and connected to the front side of said bag and the back side of said frame system, said second attachment device located above said sling.

6. The backpack of claim 5 wherein said sling includes a plurality of flex lines enabling said sling to flex horizontally and be inserted incrementally into said gap.

7. The backpack of claim 5 wherein at least one of said front side of said frame and said sling include a gripping material for reducing sliding of any cargo carried between the frame system and the bag.

8. The backpack of claim 5 including at least two generally upright stiffening members attached the front side of said bag and at least one generally horizontal stiffening member extending therebetween.

9. The backpack of claim 5 wherein first and second attachment devices each include at least one strap and at least one buckle adjustably attached thereto.

* * * * *